US005790021A

United States Patent [19]

Mickel et al.

[11] Patent Number: 5,790,021

[45] Date of Patent: Aug. 4, 1998

[54] REMOTE CONTROL FINDER

[76] Inventors: Ivor Mickel, 895 Abingdon Ct., Newport News, Va. 23602; David L. Volk, 301 Oakwood Ct., Clairton, Pa. 15025

[21] Appl. No.: 753,691

[22] Filed: Nov. 27, 1996

[51] Int. Cl.[6] ..... G08B 1/08

[52] U.S. Cl. ..... 340/539; 340/825.36; 340/825.49; 206/320

[58] Field of Search ..... 340/539, 825.49, 340/825.36; 206/320, 305

[56] References Cited

U.S. PATENT DOCUMENTS 5,642,095 6/1997 Cook ..... 340/568
5,648,757 7/1997 Vernace et al. ..... 340/539

*Primary Examiner*—Jeffery A. Hofsass
*Assistant Examiner*—Daryl C. Pope
*Attorney, Agent, or Firm*—David L. Volk

[57] ABSTRACT

A remote control holder includes a platform having two opposing long sides. A wall is disposed along each of the long sides and extends upwardly from the platform. Each wall includes a padded structure disposed along an inward facing surface thereof The padded structure includes a flexible cover thereon. A first switch is disposed within one of the padded structures adjacent the cover. A remote control unit is of sufficient width for the remote control unit to depress the first switch by urging against the padded structures and the first switch when the remote control unit is placed on the platform with the bottom broad surface parallel to and touching the platform. The first switch is connected to a first power source and a timer circuit. The timer circuit is connected to a transmitter and configured to control the operation thereof. The remote control unit includes a second power source connected to a receiver, and the receiver connected to a sound generating circuit.

4 Claims, 3 Drawing Sheets

REMOTE CONTROL FINDER

BACKGROUND OF THE INVENTION

1. Field of the Invention

The present invention relates to transmitters and receivers, specifically to a transmitter and receiver apparatus for finding a lost television remote control unit.

2. Description of the Related Art

Remote control finders are known in the prior art. A popular system houses a transmitter in the television and a receiver in the remote control unit. When the remote control unit is lost the user of the system presses a switch on the television, which causes the transmitter to activate. The receiver in the remote control unit receives the transmitted signal, and causes a sound to emanate from the remote control unit so that the unit may be found.

A disadvantage with this prior art that the user is unaware that the remote control unit is lost until he or she actually looks for it, usually when his or her desired program is about to begin. Even with the assistance of the sound emanating there-from, the remote control unit may be difficult to find, causing stress and lost viewing time.

Another disadvantage with the prior art is that a user must buy the television which has the remote control finder incorporated therein. A person without this television cannot benefit from a remote control finder system.

SUMMARY OF THE INVENTION

The remote control finder of the present invention includes a remote control holder and a remote control unit. The remote control holder includes a platform having two opposing long sides. A wall is disposed along each of the long sides and extends upwardly from the platform. Each wall includes a padded structure disposed along an inward facing surface thereof. The padded structure includes a flexible cover thereon. A first switch is disposed within one of the padded structures adjacent the cover. The remote control unit is of sufficient width for the remote control unit to depress the first switch by urging against the padded structures and the first switch when the remote control unit is placed on the platform with the bottom broad surface parallel to and touching the platform. The first switch is connected to a first power source and a timer circuit. The timer circuit is connected to a transmitter and configured to control the operation thereof. The remote control unit includes a second power source connected to a receiver, and the receiver connected to a sound generating circuit.

When the remote control unit is removed from the remote control holder, the first switch becomes non-depressed and the timer circuit energizes. After a pre-determined period of time, which may be 30 minutes, 1 or 2 hours, or any other suitable period, the transmitter will send a signal to the receiver in the remote control unit, and the remote control unit will emit a sound until a second switch on the remote control holder is turned off, or until the first switch is depressed.

Accordingly, several objects and advantages of the present invention are:

a. to provide a remote control finder which will alert a user that his or her remote control unit is lost;

b. to provide a remote control finder which is not incorporated into a television, and so may be used by persons without a specially configured television set; and c. to provide an attractively styled remote control finder with a hidden switch so that the appearance of the unit is enhanced.

Still further objects and advantages will become apparent from the ensuing description and drawings.

DETAILED DESCRIPTION

Figure 1:
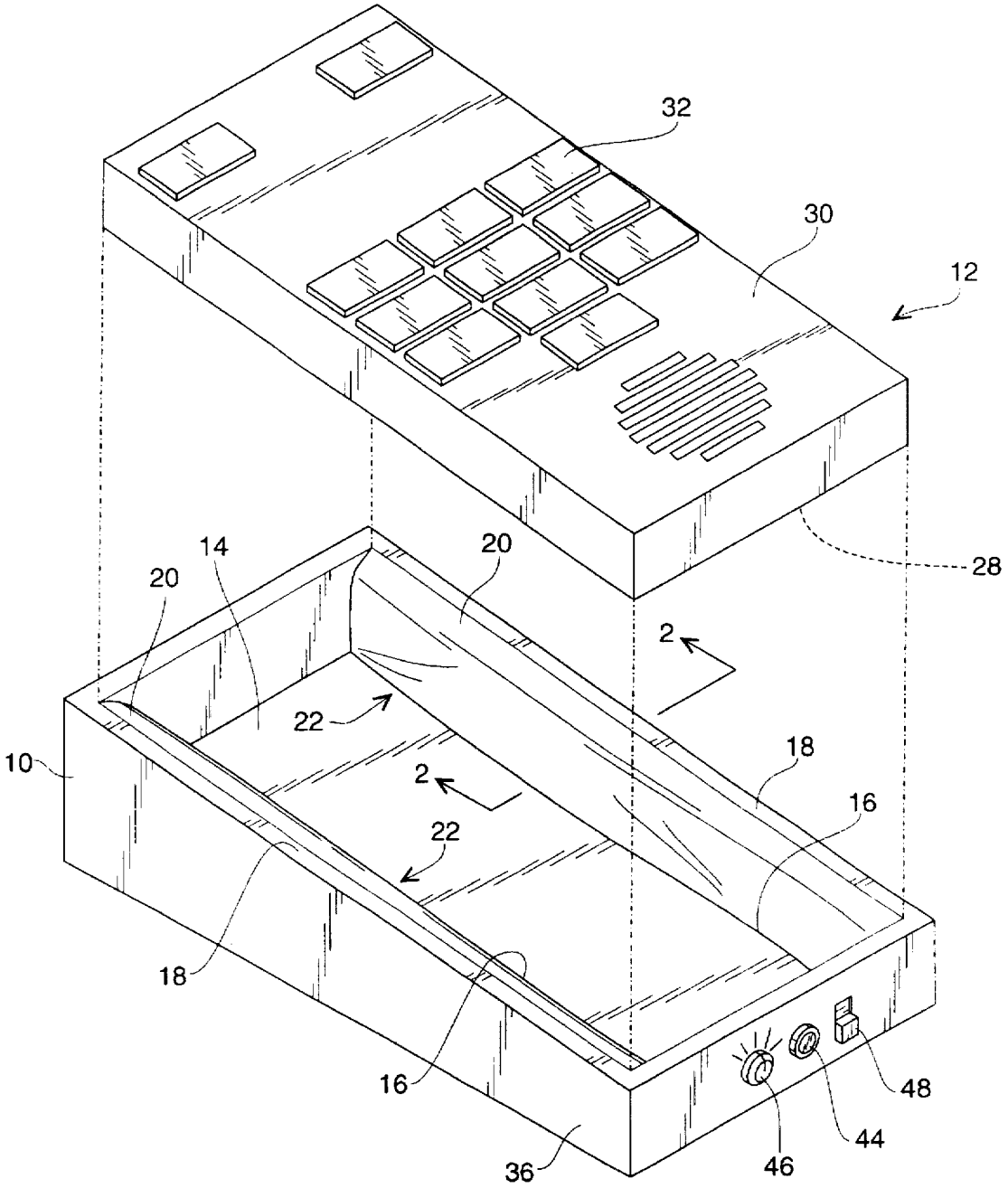
FIG. 1 is a perspective exploded view of the remote control holder and the remote control unit.

FIG. 1 is a perspective exploded view of a remote control holder 10 and a remote control unit 12. The remote control holder 10 includes a generally upwardly facing, substantially rectangular platform 14. The platform includes two opposing long sides 16, which may be seen more clearly in FIG. 2. A wall 18 is disposed along each of the long sides 16 and extends upwardly from the platform 14. The remote control unit 12 includes a bottom broad surface 28 and a top broad surface 30 including control switches 32 thereon. The control switches 32 are of the conventional type for control of a television, stereo, VCR or other device.

Figure 2:
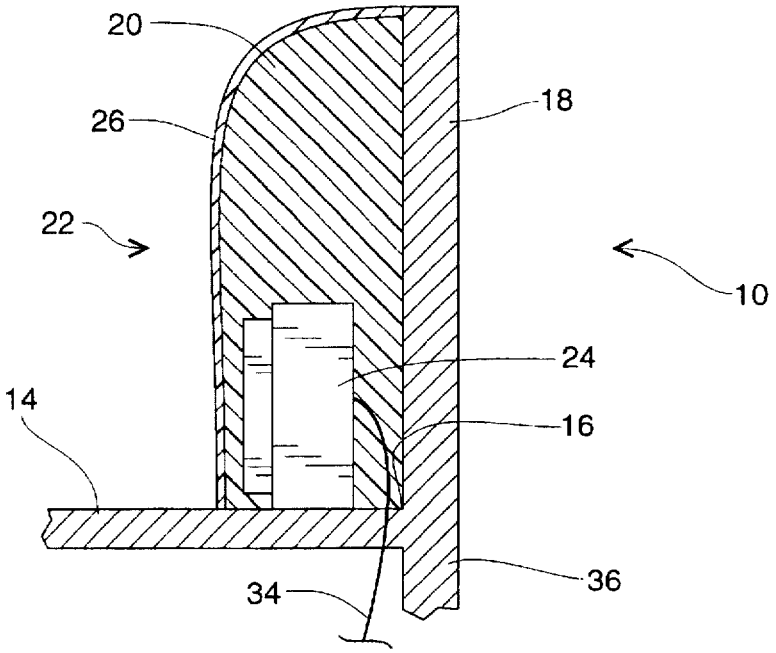
FIG. 2 is a cross-sectional view taken along line 2—2 of FIG. 1.

FIG. 2 is a cross-sectional view taken along line 2—2 of FIG. 1. Referring to FIGS. 1 and 2, each wall 18 has a padded structure 20 disposed on an inward facing surface 22 of the wall, the padded structure 20 having a flexible cover 26 thereon. A first switch 24 is disposed within one of the padded structures 20 adjacent the cover 26.

Figure 3:
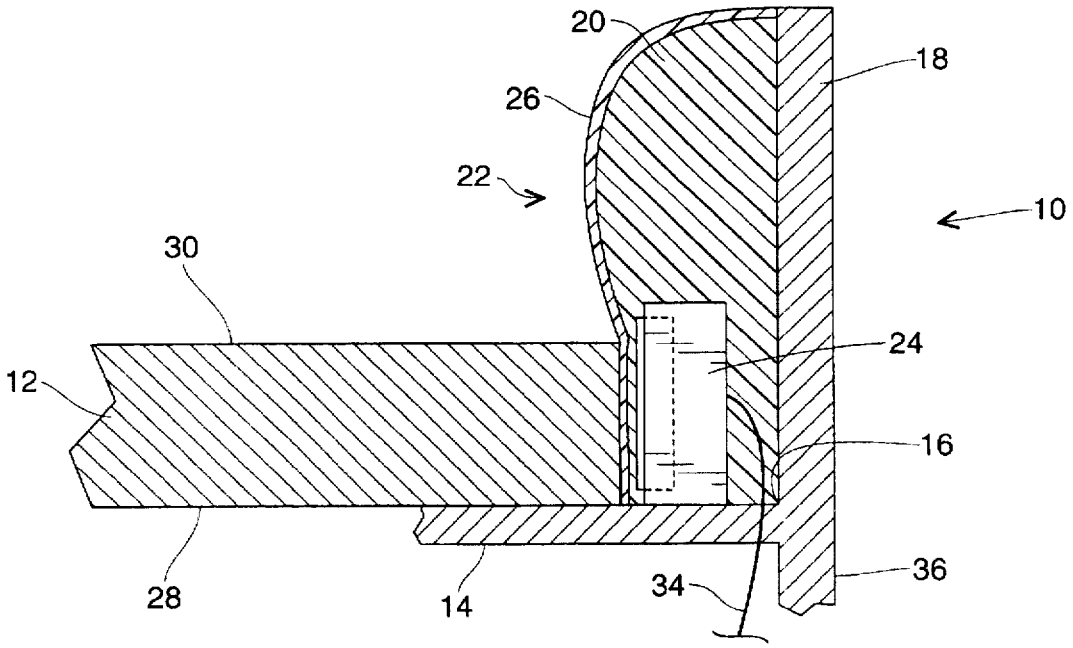
FIG. 3 is a cross-sectional view taken along the same line as FIG. 2, showing the remote control unit positioned on the platform of the remote control holder, and showing the switch in a depressed position.

FIG. 3 is a cross-sectional view taken along the same line as FIG. 2, showing the remote control unit 12 positioned on the platform 14 of the remote control holder 10, and showing the first switch 24 in a depressed position. The remote control unit 12 is of a sufficient width to depress the first switch 24 by urging against the padded structure 20 and the first switch 24 when the remote control unit 12 is placed on the platform 14 with the bottom broad surface 28 parallel to and touching the platform 14. A wire 34 leads from the first switch 24 into the base 36 of the remote control holder 10.

Figure 4:
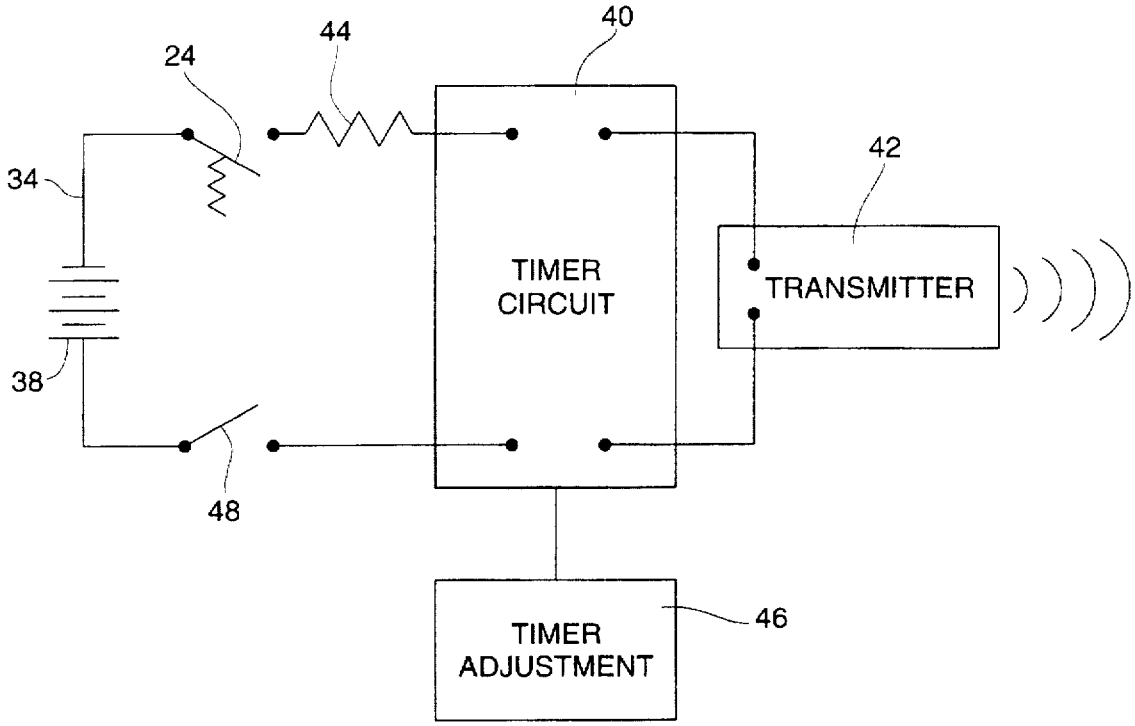
FIG. 4 is a block schematic diagram of the circuitry within the remote control holder.

FIG. 4 is a block schematic diagram of the circuitry within the base 36 of the remote control holder 10. The first switch 24 is connected to a first power source 38 and a timer circuit 40. When the first switch 24 is depressed, the timer circuit 40 is de-energized, and when the first switch 24 is non-depressed, the timer circuit 40 is energized. The timer circuit 40 is connected to a transmitter 42 and configured to control the operation thereof. The transmitter 42 energizes and begins to transmit signals after a pre-determined first time period of the timer circuit 40 being continuously energized.

A lamp 44 is connected to the first switch 24. The lamp 44 de-energizes when the first switch 24 is depressed and energizes when the switch 24 is non-depressed. Referring back to FIG. 1, the lamp 44 may be disposed in a viewable location on an outside surface of the remote control holder 10.

The timer circuit 40 includes a timer adjustment 46 configured to permit manual adjustment of the first time period between the timer circuit 40 becoming energized and the transmitter 42 energizing and transmitting signals. Referring back to FIG. 1, the manual adjustment 46 may be located on any accessible portion of the remote control holder 10 such as next to the lamp 44 or on a recessed bottom (not shown) of the base 36.

A manual second switch 48 is in series with the first switch 24. When the first switch 24 is open, the timer circuit 40, the transmitter 42 and the lamp 44 are de-energized, or prevented from being energized. When the second switch 48 is closed and the first switch 24 is non-depressed, the timer circuit 40 and the lamp 44 will energize as described above. Referring back to FIG. 1, the manual second switch 48 may be located on any accessible portion of the remote control holder 10 such as next to the lamp 44 or on a recessed bottom (not shown) of the base 36.

Figure 5:
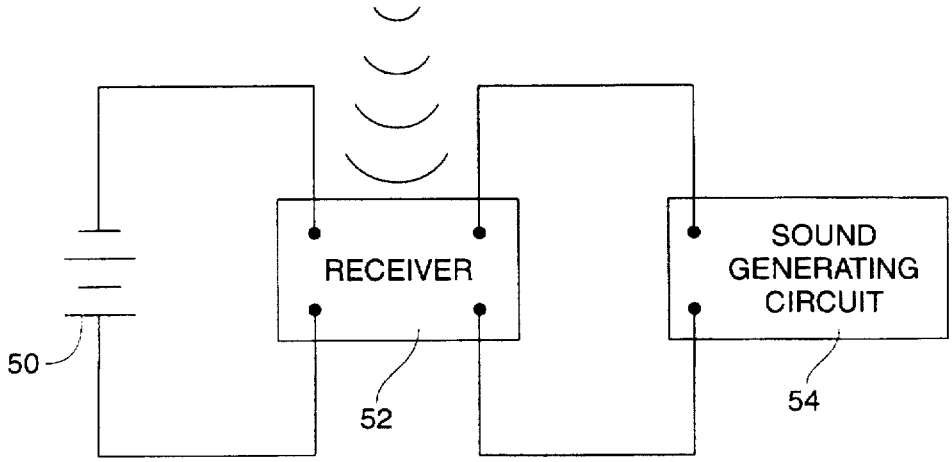
FIG. 5 is a block schematic diagram of the circuitry within the remote control unit.

FIG. 5 is a block schematic diagram circuitry within the remote control unit 12. The remote control unit 12 includes a second power source 50 connected to a receiver 52. The receiver 52 is connected to a sound generating circuit 54. When the receiver 52 receives a signal from the transmitter 42, a sound is emitted from the remote control unit 12.

When the remote control unit 12 is removed from the remote control holder 10, the first switch 24 becomes non-depressed and the timer circuit 40 energizes. After a pre-determined period of time, which may be 30 minutes, 1 or 2 hours, or any other suitable period as set by the manual timer adjustment 46, the transmitter 42 will send a signal to the receiver 52 in the remote control unit 12, and the remote control unit 12 will emit a sound until the second switch 48 on the remote control holder 10 is turned off or until the remote control unit 12 is returned to the remote control holder 10, thus depressing the first switch 24.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. For example, various other well known configurations of electronic circuitry and components to accomplish the functions described herein are possible and within the scope of the present invention. The scope of the invention is to be limited only by the following claims and their legal equivalents.

The invention claimed is:

1. A remote control finding apparatus comprising:

a. a remote control holder having a generally upwardly facing, substantially rectangular platform, the platform having two opposing long sides;

b. a wall disposed along each of the long sides and extending upwardly from the platform;

c. each wall having an inward facing surface;

d. each wall having a padded structure disposed along the inward facing surface, the padded structure having a flexible cover thereon;

e. a first switch disposed within one of the padded structures adjacent the cover;

f. a remote control unit having a width, a bottom broad surface and a top broad surface including control switches thereon;

g. the width of the remote control unit being sufficient for the remote control unit to depress the first switch by urging against the padded structures and the first switch when the remote control unit is placed on the platform with the bottom broad surface parallel to and touching the platform.

h. the first switch connected to a first power source and a timer circuit, such that when the first switch is depressed, the timer circuit is de-energized, and when the first switch is non-depressed, the timer circuit is energized;

i. the timer circuit connected to a transmitter and configured to control the operation thereof, such that the transmitter becomes energized after a pre-determined first time period of the timer circuit being continuously energized; and j. the remote control unit including a second power source connected to a receiver, and the receiver connected to a sound generating circuit, the receiver and the sound generating circuit configured such that a sound is emitted from the remote control unit when the receiver receives a signal from the transmitter.

2. The remote control finding apparatus of claim 1, further including a lamp connected to the first switch and configured such that the lamp de-energizes when the first switch is depressed and energizes when the first switch is non-depressed, the lamp being disposed in a viewable location on an outside surface of the remote control holder.

3. The remote control finding apparatus of claim 1, further including a timer adjustment configured to permit manual adjustment of the first time period.

4. The remote control finding apparatus of claim 1, further including a manual second switch in series with the first switch and configured to alternatively permit and prevent operation of the timer circuit.

* * * * *